US009714161B2

(12) United States Patent
Riggio

(10) Patent No.: US 9,714,161 B2
(45) Date of Patent: Jul. 25, 2017

(54) FILLING DEVICE

(71) Applicant: SMI S.p.A., Bergamo (IT)

(72) Inventor: Antonio Riggio, Bergamo (IT)

(73) Assignee: SMI S.p.A., Bergamo (IT)

( * ) Notice: Subject to any disclaimer, the term of this patent is extended or adjusted under 35 U.S.C. 154(b) by 196 days.

(21) Appl. No.: 14/314,230

(22) Filed: Jun. 25, 2014

(65) Prior Publication Data

US 2015/0013832 A1 Jan. 15, 2015

(30) Foreign Application Priority Data

Jul. 10, 2013 (IT) ..... MI2013A001163

(51) Int. Cl.

| | |
|---|---|
| ***B65B 31/00*** | (2006.01) |
| ***B67C 7/00*** | (2006.01) |
| ***B67C 3/00*** | (2006.01) |
| ***B67C 3/26*** | (2006.01) |
| ***B67C 3/28*** | (2006.01) |
| *B67C 3/22* | (2006.01) |

(52) U.S. Cl.

CPC ..... *B67C 7/0073* (2013.01); *B67C 3/002* (2013.01); *B67C 3/26* (2013.01); *B67C 3/282* (2013.01); *B67C 3/286* (2013.01); *B67C 2003/228* (2013.01)

(58) Field of Classification Search

CPC ..... B67C 7/0073; B67C 3/282; B67C 3/002; B67C 3/286–3/288; B67C 3/26; B67C 2003/228; B67C 3/001–3/004; B65B 55/10

See application file for complete search history.

(56) References Cited

U.S. PATENT DOCUMENTS 1,364,555 A * 1/1921 Hunt ..... B65B 39/003 137/862
3,350,839 A * 11/1967 Carter ..... B67B 3/24 53/510
3,356,510 A * 12/1967 Barnby ..... B65B 55/02 141/11
3,498,508 A 3/1970 Francisoud et al.
3,635,263 A * 1/1972 Jordon ..... B67C 3/2614 141/286
3,830,265 A * 8/1974 Matejek ..... B67C 3/08 137/170.1
4,976,295 A * 12/1990 Clusserath ..... B67C 3/06 141/39
4,982,768 A * 1/1991 Ahlers ..... B67C 3/10 141/301
4,989,650 A * 2/1991 Weiss ..... B67C 3/06 141/198

(Continued)

FOREIGN PATENT DOCUMENTS

DE 39 37 630 A1 6/1990
DE 42 19 082 A1 12/1993

(Continued)

*Primary Examiner* — Timothy L Maust
*Assistant Examiner* — Randall Gruby
(74) *Attorney, Agent, or Firm* — Blank Rome LLP

(57) ABSTRACT

The present invention relates to a filling device for food product packaging plants in special containers. Particularly, the invention relates to a filling device of the electronic type, in which a contact between the valve and the container to be filled does not occur.

7 Claims, 3 Drawing Sheets

(56) References Cited

U.S. PATENT DOCUMENTS 5,377,726 A * 1/1995 Clusserath ..... B67C 3/286 141/261
5,558,135 A * 9/1996 Kronseder ..... B67C 3/10 141/39
6,082,418 A * 7/2000 Naecker ..... B65B 31/022 141/145
7,308,917 B2 * 12/2007 Krulitsch ..... B67C 3/26 141/198
7,469,726 B2 * 12/2008 Clusserath ..... B67C 3/04 141/144
7,571,749 B2 * 8/2009 Stocchi ..... B67C 3/004 141/105
7,650,916 B2 * 1/2010 Clusserath ..... B67C 3/002 141/198
8,590,581 B2 * 11/2013 Clusserath ..... B67C 3/001 141/9
8,833,407 B2 * 9/2014 Clusserath ..... B67C 3/2608 141/115
9,193,574 B2 * 11/2015 Krulitsch ..... B67C 3/26
9,205,937 B2 * 12/2015 Krulitsch ..... B67C 3/26
2003/0150517 A1 * 8/2003 Decarne ..... B67C 3/26 141/286
2005/0103399 A1 * 5/2005 Till ..... B65G 47/846 141/85
2005/0126118 A1 * 6/2005 Till ..... B67C 7/0086 53/167
2005/0241726 A1 * 11/2005 Clusserath ..... B67C 3/04 141/144
2007/0074783 A1 * 4/2007 Stocchi ..... B67C 3/004 141/264
2008/0223477 A1 * 9/2008 Stocchi ..... B67C 3/242 141/1
2009/0095370 A1 * 4/2009 Krulitsch ..... B67C 3/004 141/6
2009/0236007 A1 * 9/2009 Clusserath ..... B65B 3/26 141/9
2010/0037983 A1 2/2010 Hiroya et al.
2010/0065150 A1 * 3/2010 Conforti ..... B67C 3/10 141/100
2010/0108180 A1 * 5/2010 Clusserath ..... B67C 3/004 141/1
2010/0132834 A1 * 6/2010 Cusserath ..... B67C 3/045 141/115
2010/0313959 A1 * 12/2010 Termansen ..... B65B 39/004 137/1
2011/0030843 A1 * 2/2011 Krulitsch ..... B67C 3/2614 141/311 R
2011/0039044 A1 * 2/2011 Clusserath ..... B67C 3/001 428/34.1
2011/0303325 A1 * 12/2011 Gras ..... B67C 3/007 141/105
2012/0186695 A1 * 7/2012 Clusserath ..... B67C 3/2608 141/115
2014/0366982 A1 * 12/2014 Clusserath ..... B67C 3/26 141/104
2016/0090290 A1 * 3/2016 Chapron ..... A01M 7/0085 141/65

FOREIGN PATENT DOCUMENTS

DE 10 2010 012 577 A1 9/2011
EP 2 439 169 A1 4/2012
WO WO 2005/003018 A1 1/2005
WO WO 2008/006446 A1 1/2008

* cited by examiner

FILLING DEVICE

The present invention relates to a filling device for food product packaging plants in suitable containers. Particularly, the invention relates to a filling device of the electronic type, in which a contact between the valve and the container to be filled does not occur. Specifically, the invention relates to the beverage bottling field.

The filling valves of the state of the art may belong to two different types: mechanical valves and electronically controlled valves.

The former ones always provide a contact between the filling fluid dispensing nozzle and the bottle neck, necessary to be able to determine the bottle filling level and to stop the dispensed flow. A drawback of this type of valves is that, for example, in the case that a bottle should be contaminated for any reasons, such contamination could be transmitted to the valve itself, hence to the next containers. This is a severe problem, since the sanitization of valves, containers, and all the surrounding thereof is a considerably relevant aspect in the field.

Vice versa, the electronic valves do not provide for any direct contact with the bottle, thus eliminating the problem of the transmission of a possible contamination. However, this type of valves is also exposed to the risk of embedding into the dispensed flow entering the container possible corpuscles that are present in the environment.

In order to obviate this drawback, which may be present in all the types of filling machines, both mechanical and electronic ones, it is known to enclose the machine working area in a controlled atmosphere environment, in which a sterile air overpressure is created, so as to prevent air contaminated from the outside from accessing the working area. However, this solution, even if it is widely used, is burdensome due to the considerable volume that has to be kept under control, and in any case it does not ensure the complete absence of contaminations under many operative circumstances, such as, for example, an operator access into the filling machine operative area.

The attention for the sanitization of the working place and in particular of the filling device is a prominent aspect. An example of a prior art electronic valve is shown In FIG. 1, in which a side duct connecting an annular chamber surrounding the dispensing nozzle is visible. Such duct, known as a CIP (Clean-In-Place) return duct, is common to all the filling valves in order to clean and disinfect all those parts contacting the product. Basically, during the cleaning and sanitization step the valve is plugged inferiorly, and a sanitizing liquid is inserted through the product supply duct. The liquid runs along the valve dispensing duct, exits the nozzle, fills the annular chamber surrounding it, and exits the side duct as shown by the arrows.

The problem addressed by the present invention is to provide a filling device allowing overcoming one or more of the drawbacks set forth above, and particularly allowing avoiding external contaminations of the container undergoing a filling operation.

Such a problem is solved by a filling device as set forth in the appended claims, the definitions of which are an integral part of the present description.

Therefore, an object of the invention is a filling valve and a filling machine including it, capable of avoiding external contaminations of the container undergoing a filling operation.

A further object of the invention is a method of using a filling device capable of avoiding external contaminations of the container undergoing a filling operation.

Further characteristics and advantages of the present invention will be more apparent from the description of some embodiment examples, given herein below by way of illustrative, non-limiting example, with reference to the following figures.

Figure 1:
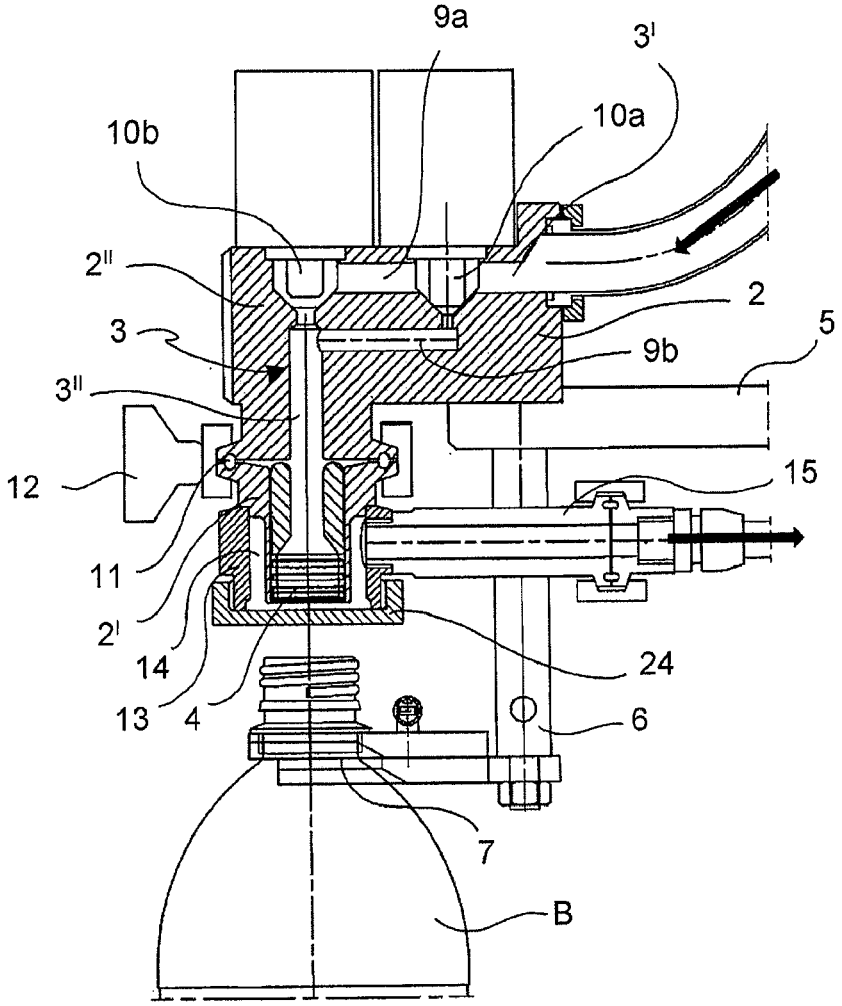
FIG. 1 PRIOR ART
FIG. 1 represents a sectional side view of a filling device according to the state of the art, in a sanitization step.

With reference to the figures, the filling device according to the invention, indicated on the whole with the number 1, comprises a body 2 in which a dispensing duct 3 for a filling fluid is obtained. The dispensing duct 3 ends inferiorly with a dispensing nozzle 4.

The body 3 is secured to a filling machine (not shown) by a support bar 5. A support arm 6 for a bottle B is also secured to the support bar 5. The support arm 6 is L-shaped and ends with a fork 7 capable of engaging the neck of the bottle B.

The dispensing duct 3 is connected to a filling fluid supply pipe 8.

In certain embodiments, the dispensing duct 3 comprises a substantially horizontal first length 3' and a second vertical length 3" opening into the dispensing nozzle 4. In some embodiments, the first length 3' comprises two substantially parallel branches 9*a*, 9*b*, intercepted by two valve means 10*a*, 10*b*. The two branches 9*a*, 9*b* have different diameters. In this manner, it is possible to direct the filling fluid flow through the first branch 9*a* having a larger diameter or through the second branch 9*b* having a smaller diameter, modifying the dispensed fluid flow rate.

Figure 2:
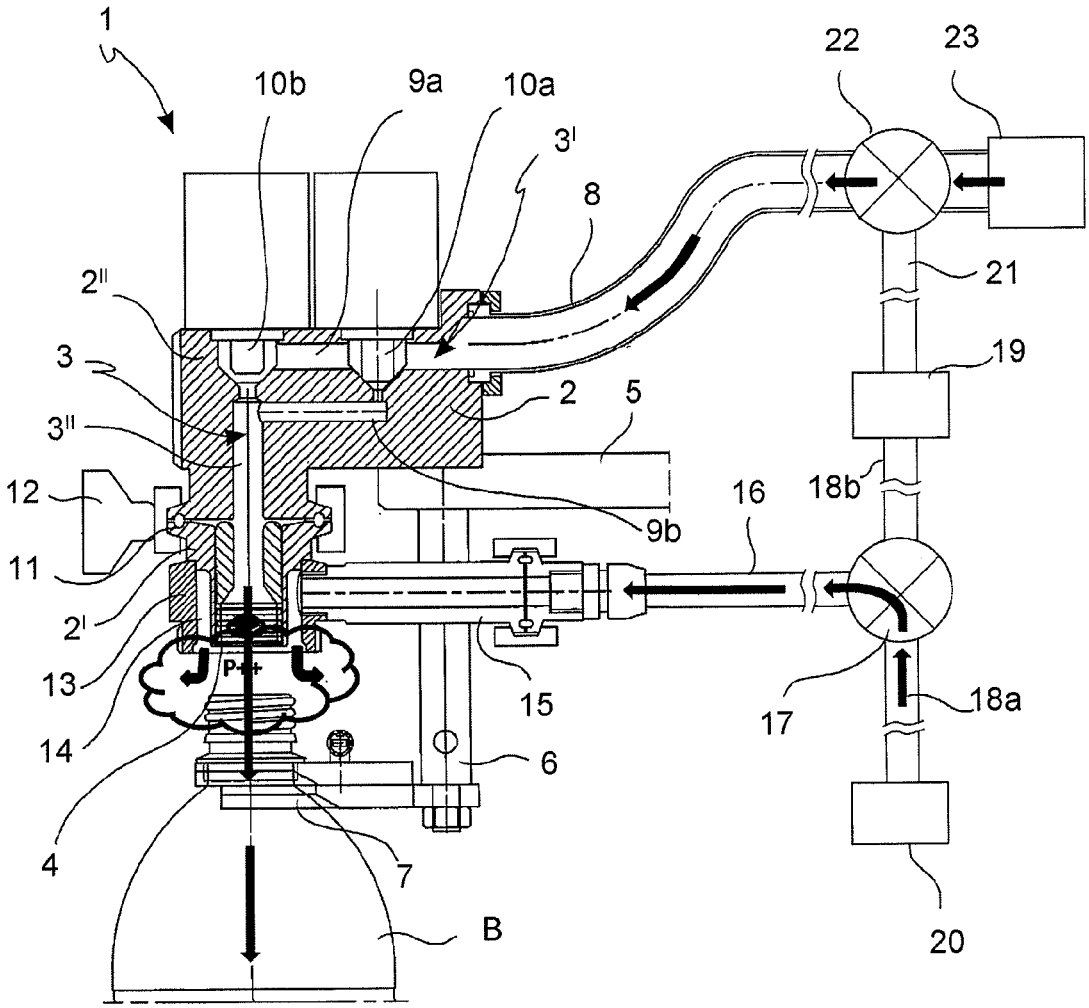
FIG. 2 represents a sectional side view of a filling device according to the invention, in an operative condition.

In the embodiment shown in FIG. 2, the lower portion 2' of the body 2, comprising the end portion of the dispensing duct 3 and the dispensing nozzle 4, is detachable from the remaining fixed portion 2", so as to allow the maintenance or replacement thereof according to the different dispensing needs. To this aim, the joining surface of the two portions 2', 2" comprises a gasket 11 (typically, an O-ring) and suitable securing means 12.

However, it is apparent that, in other embodiments, the lower portion 2' and the fixed portion 2" of the body 2 may form a single piece.

The lower portion 2' of the body 2 comprises a sleeve 13 surrounding the dispensing nozzle 4, so as to create an interspace forming an annular chamber 14 between the outer surface of the nozzle 4 and the inner surface of the sleeve 13.

The sleeve 13 is connected to a sanitization duct 15. The sanitization duct 15 is, in turn, connected to a tube 16 that separates, with the interposition of a suitable valve means 17, for example, a three-way valve or the like, into a first line 18*a* connected to a source 20 of a gaseous sanitization fluid, and a second line 18*b* connected to a collection tank 19 of a liquid sanitization fluid, from which the liquid sanitization fluid will be able to be recirculated into the dispensing duct 3 of the valve body 2, by the tube 21 and the valve means 22, or discarded. Therefore, in this manner it is possible to put the annular chamber 14 in communication with said source 20 of gaseous sanitization fluid, as it will be explained herein below.

The product for filling the bottles B is withdrawn from a special tank 23 and inserted into the supply pipe 8 through the valve means 22. Thus the valve means 22 allow selecting the operative filling step or the sanitization step.

In preferred embodiments, the sanitization duct 15 is the CIP duct already present in the prior art filling devices, from which the device of the invention distinguishes itself for the presence of both a recirculation duct for the liquid sanitization fluid that is typical of the CIP (Clean-In-Place) treatment, and a connection to a gaseous sanitization fluid, the function of which will be explained further below.

In alternative embodiments, separate sanitization ducts will be able to be provided for the liquid fluid and the gaseous fluid.

In preferred embodiments, the filling device 1 is an electronically controlled device, whereby it is operatively connected to a driving and control unit that drives the operation of the valve means 10*a*, 10*b*, 17, and 22.

The operation of the filling device of the invention is as follows.

In the operative condition, the filling fluid is withdrawn from the tank 23 and it is inserted, through the valve means 22 and the supply duct 8, into the dispensing duct 3, from which it is then dispensed through the dispensing nozzle 4 into the bottle B. Concomitantly, the valve means 17 put the source 20 of a gaseous sanitization fluid in flow communication with the annular chamber 14. Then the gaseous sanitization fluid, typically sterile air or a sterile inert gas exits the annular chamber 14 surrounding the filling liquid flow dispensed by the filling device 1, thereby ensuring its insulation from the external environment.

The overpressure with which the gaseous sanitization fluid exits the annular chamber 14, indicated with "P++", is above the overpressure that is usually present in the filling machine working area with respect to the external environment (indicated with "P++"), whereby a gaseous fluid flow is efficiently created, which from the neck of the bottle B irradiates outwardly. Thus, the penetration of dust or other pollutants into the bottle B is prevented.

Figure 3:
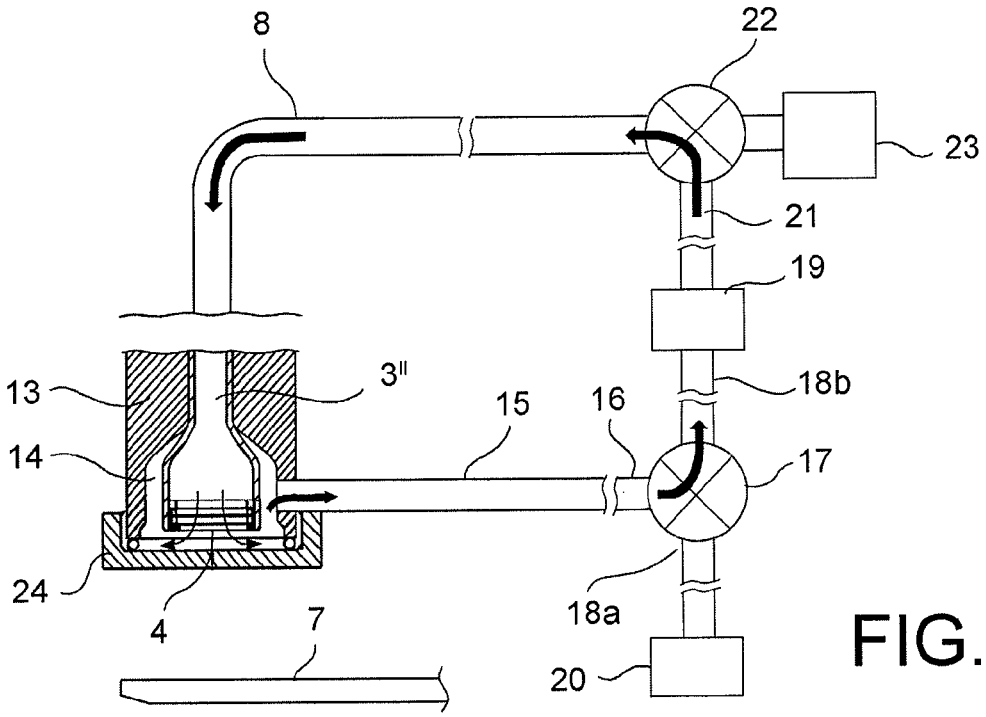
FIG. 3 represents a schematic view of the device of FIG. 2, during the sanitization step.

On the contrary, in a non-operative maintenance step (FIG. 3), the filling device 1 opening will be sealed by a suitable closure 24, and a liquid sanitization fluid will be inserted through the valve means 22 and the supply duct 8, it will circulate in the dispensing duct 3 and the annular chamber 14, then it will be removed through the sanitization duct 15. In this case, the valve means 17 will direct the exiting liquid fluid into the tank 19.

Figure 4:
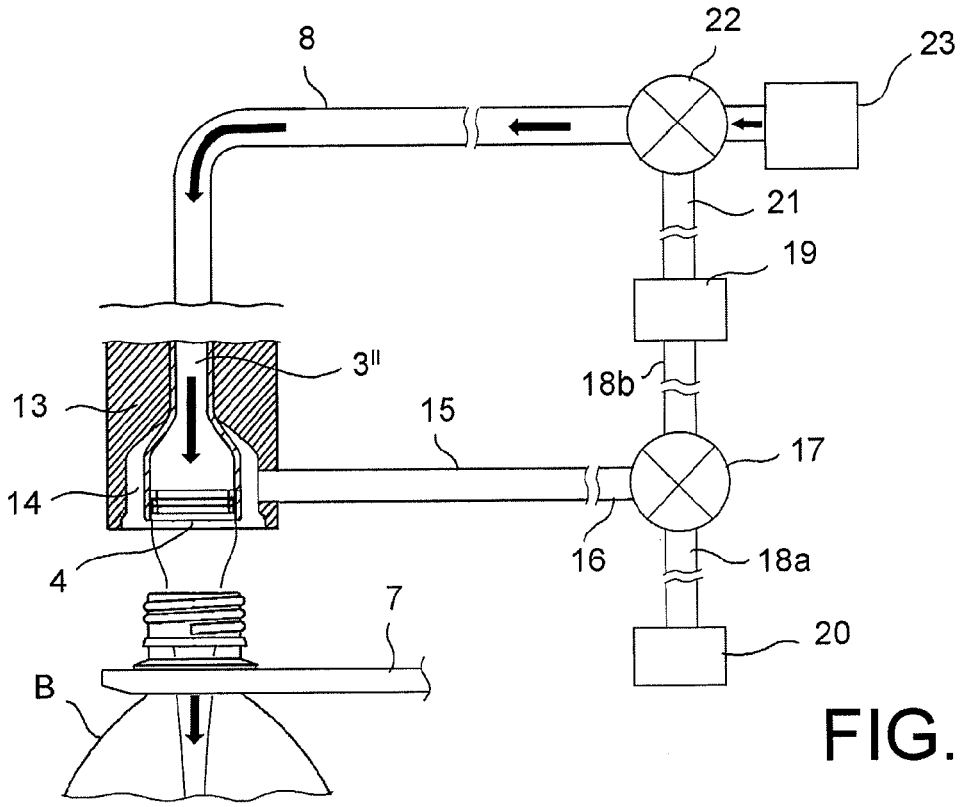
FIG. 4 represents a schematic view of the device of FIG. 2, in a different operative condition.

In a different operative condition, shown in FIG. 4, a conventional filling of a container with a filling liquid withdrawn from the tank 23 will be able to be carried out. In this case, which can be applied to types of products that do not require a specific sanitization, the sanitizing gas will be excluded.

Therefore, a further object of the present invention is a method for filling a container B, providing for:

a) providing a filling machine comprising at least one filling device 1 as defined above, said filling machine comprising a confined operative environment having an overpressure of a substantially sterile fluid with respect to the external environment, b) connecting the sanitization duct 15 of said at least one filling device 1 with a source 20 of a gaseous sanitization fluid, c) dispensing a filling fluid through the dispensing nozzle 4 of said at least one filling device 1, d) concomitantly with said step c), dispensing said gaseous sanitization fluid through said sanitization duct 15 and said annular chamber 14, so as to create a substantially sterile surrounding around the flow of dispensed filling fluid and around the neck of said container B, in which said sanitization fluid has an overpressure with respect to the confined operative environment of the filling machine 1.

The confined operative environment of a filling machine is usually obtained by arranging a series of side and upper panels that enclose the machine. Sterile air with a slight overpressure with respect to the external environment is typically inserted into such confined environment, so as to avoid the inlet of air possibly contaminated from the outside.

The advantages of the present invention are apparent from what has been described above.

In fact, the filling device of the invention solves the problem of avoiding the contamination of the containers to be filled and the filling fluid, creating a substantially sterile surrounding in the proximity of the filling fluid dispensing point.

This result is achieved without substantially modifying the valve structure, since a conventional filling device will be able to be used, connecting the CIP duct also to a source of a gaseous sanitization fluid as described above. Therefore, the same CIP duct will have the double function of a discharge duct for a liquid sanitization fluid during the non-operative maintenance step of the valve, and an inlet duct for a gaseous sanitization fluid during the operative step of the filling machine.

It is apparent that only some particular embodiments of the present invention have been described, to which those skilled in the art will be able to make all those modifications that are necessary for the adaptation thereof to particular applications, without anyhow departing from the protection scope of the present invention.

The invention claimed is:

1. A filling device comprising a body in which a dispensing duct for a filling fluid is obtained, the dispensing duct ending inferiorly with a dispensing nozzle, wherein the lower portion of the body comprises a sleeve surrounding the dispensing nozzle, so as to create an annular chamber between the outer surface of the dispensing nozzle and the inner surface of the sleeve, wherein said sleeve is connected to a sanitization duct which is arranged in flow communication with a source of a gaseous sanitization fluid, wherein the sanitization duct is connected to a tube that separates, with the interposition of a first valve, into a first line connected to said source of gaseous sanitization fluid, and a second line connected to a collection tank of a liquid sanitization fluid, from which the liquid sanitization fluid can be recirculated into the dispensing duct, by a tube and a second valve, during a maintenance step.

2. The filling device according to claim 1, wherein said dispensing duct is connected to a filling fluid supply pipe and comprises a substantially horizontal first length and a second vertical length opening into the dispensing nozzle, wherein the first length comprises two substantially parallel branches intercepted by two valve means and having different diameters.

3. The filling device according to claim 1, wherein the lower portion of the body comprises the end portion of the dispensing duct and the dispensing nozzle, and it is detachable from a remaining fixed portion.

4. The filling device according to claim 1, wherein said filling device is an electronically controlled device operatively connected to a driving and control unit that drives the operation of the first valve.

5. A filling machine comprising at least one filling device according to claim 1.

6. The filling machine according to claim 5, further comprising a confined operative environment having an overpressure of a substantially sterile fluid with respect to the external environment.

7. The filling machine according to claim 6, wherein said confined operative environment comprises a series of side and upper panels that enclose the filling machine, a sterile gaseous fluid having an overpressure with respect to the external environment being inserted into such confined environment.

* * * * *